US008540419B2

(12) United States Patent
Winkler et al.

(10) Patent No.: US 8,540,419 B2
(45) Date of Patent: Sep. 24, 2013

(54) DECORATIVE PIECE MADE BY INLAY

(75) Inventors: Yves Winkler, Schmitten (CH); Stewes Bourban, Cudrefin (CH); Jean-François Dionne, Kerzers (CH)

(73) Assignee: Omega S.A., Bienne (CH)

( * ) Notice: Subject to any disclaimer, the term of this patent is extended or adjusted under 35 U.S.C. 154(b) by 456 days.

(21) Appl. No.: 13/000,742

(22) PCT Filed: Jun. 22, 2009

(86) PCT No.: PCT/EP2009/057737

§ 371 (c)(1),
(2), (4) Date: Jun. 22, 2009

(87) PCT Pub. No.: WO2010/006887

PCT Pub. Date: Jan. 21, 2010

(65) Prior Publication Data

US 2011/0103199 A1 May 5, 2011

(30) Foreign Application Priority Data

Jun. 23, 2008 (EP) ..... 08158771

(51) Int. Cl.
*G04B 47/04* (2006.01)

(52) U.S. Cl.
USPC ..... 368/285; 368/232

(58) Field of Classification Search
USPC ..... 368/232, 285; 428/67
See application file for complete search history.

(56) References Cited

U.S. PATENT DOCUMENTS

| | | | | |
|---|---|---|---|---|
| 3,451,869 | A * | 6/1969 | Nydegger | 156/73.1 |
| 3,633,355 | A * | 1/1972 | Sakata | 368/296 |
| 3,676,997 | A * | 7/1972 | Fujimori | 368/291 |
| 5,270,612 | A * | 12/1993 | Fogelson | 313/477 R |
| 6,863,435 | B2 * | 3/2005 | Moteki et al. | 368/140 |
| 2002/0036034 | A1 | 3/2002 | Xing et al. | |

FOREIGN PATENT DOCUMENTS

| | | | |
|---|---|---|---|
| DE | 502 401 | C | 7/1930 |
| FR | 1 257 141 | A1 | 3/1961 |
| JP | 54-122614 | A | 9/1979 |
| JP | 55-145139 | A | 11/1980 |
| JP | 56-066780 | A | 6/1981 |
| WO | 2004/047582 | A | 6/2004 |

OTHER PUBLICATIONS

Definition—inlay :: dictionary.com :: May 14, 2013.*
International Search Report issued in the corresponding application No. PCT/EP2009/057737, completed Nov. 30, 2009 and mailed Dec. 16, 2009.

* cited by examiner

*Primary Examiner* — Sean Kayes
(74) *Attorney, Agent, or Firm* — Griffin & Szipl, P.C.

(57) ABSTRACT

The present invention concerns a decorative piece (1) including a first (2) and a second part (3). The second part (3) is secured in the first part (3) by inlay. The invention is characterized in that at least one of the parts (2, 3) is made of an at least partially amorphous material.

33 Claims, 3 Drawing Sheets

Fig. 3
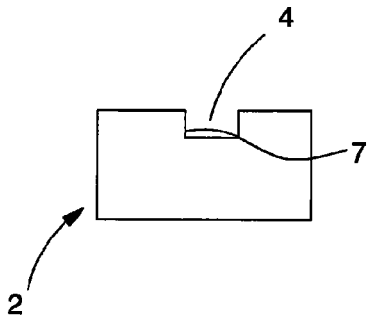
Fig. 4
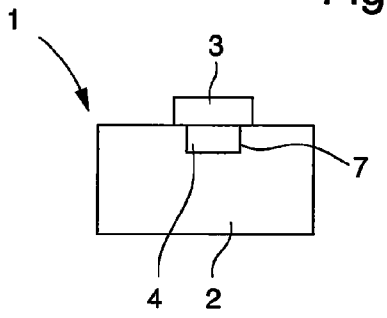
Fig. 5
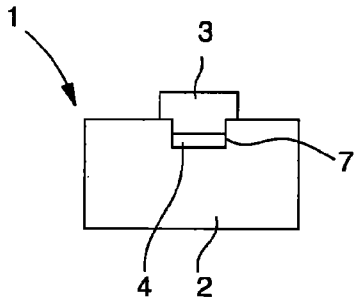
Fig. 6
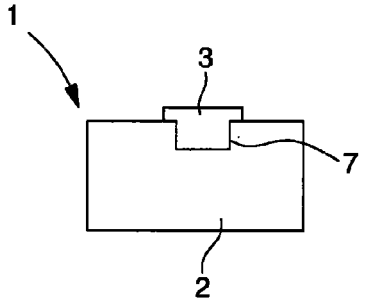
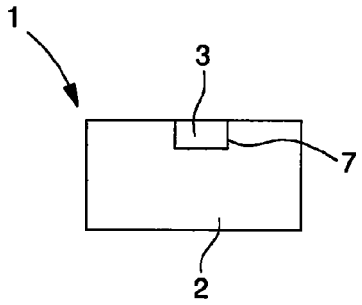
Fig. 7

Fig. 8
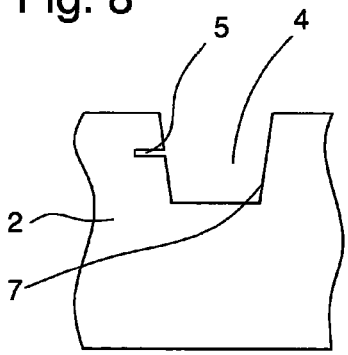
Fig. 9
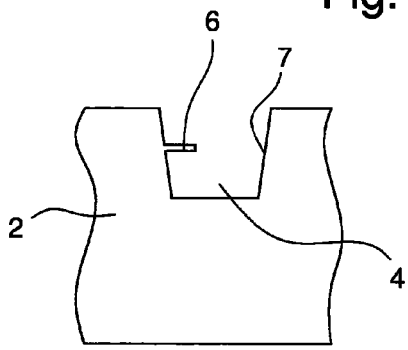
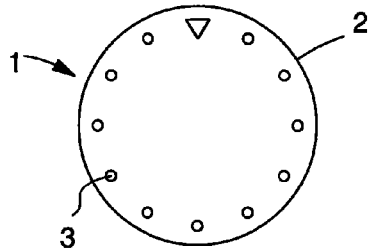
Fig. 10
Fig. 11
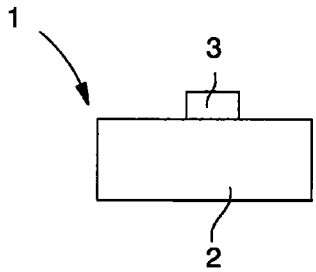
Fig. 12
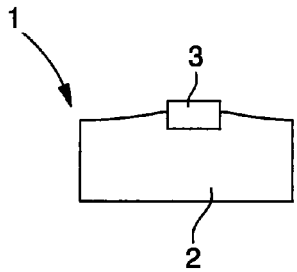
Fig. 13
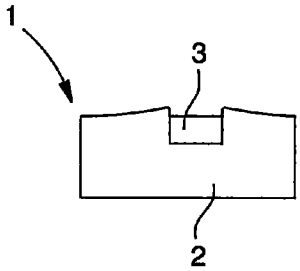
Fig. 14
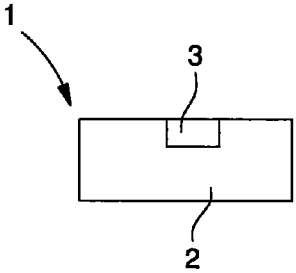

DECORATIVE PIECE MADE BY INLAY

This is a National Phase Application in the United States of International Patent Application PCT/EP2009/057737 filed Jun. 22, 2009, which claims priority on European Patent Application No. 08158771.9 of Jun. 23, 2008. The entire disclosures of the above patent applications are hereby incorporated by reference.

The present invention concerns a decorative piece. This decorative piece includes a first part and a second part. The second part is inlaid in the first.

BACKGROUND OF THE INVENTION

In the prior art there are known decorative pieces that are to be added to a portable object such as a watch and that consist of an aesthetic element inlaid on the elements of said portable object. For example, there exist watch bezels decorated with patterns such as signs. These bezels, which can be made of ceramic, can be marked in various ways and with various materials, such as gold, silver or platinum. The marking may be embossed or at a depth. In the case of deep marking, this is achieved by filling preformed hollows in the support. The principle used for performing such marking consists in depositing a layer of conductive primer by physical vapour deposition (PVD). Once the primer layer has been deposited, the hollows are filled with metal by electroforming. This method consists in dipping the piece to be marked in a bath containing metallic ions and passing an electric current through the bath in order to deposit metal atoms from the bath onto the piece to be decorated. The hollows are then filled with metal, thus allowing said marking to be achieved.

However, this type of method is complex and extremely slow. Indeed, the method requires a heavy material and includes numerous steps requiring extremely precise parameter control for the marking to be successful.

Moreover, the reproducibility of this electroforming method is dependent upon the constancy of external parameters such as pressure, temperature, time and the concentration of chemical elements, which involves significant monitoring of the method. Thus deviations from the method and thus the heterogeneity of the manufactured pieces can thus easily occur. It should also be mentioned that this electroforming method can only inlay chemical elements that are compatible with electroforming.

Finally, this electroforming method cannot deposit chemical elements beyond a certain thickness, which limits the depth of the hollows. Consequently, a maximum deposition thickness of 400 μm is generally the limit observed.

Decorative pieces formed of a metal support in which elements such as glass are inlaid are also known from the prior art. For this, the elements to be inlaid are arranged in a mould, then the metal used as support is poured over the elements. Everything is then cooled, and then polished, to form the final piece.

However, one drawback of this method is that shrinkage phenomenon is inevitable when the liquid alloy solidifies in crystalline form. This phenomenon then either causes the inlaid elements to come loose, or significant mechanical stress on the inlaid elements that may cause them to break. This method can only inlay elements whose melting point is higher than that of metal. In the particular case of the ceramic-metal system, an additional limit of this method is the long process time. Indeed, the poor resistance of ceramic to thermal shocks involves slow heating and cooling speeds.

SUMMARY OF THE INVENTION

The invention concerns a decorative piece that overcomes the aforementioned drawbacks of the prior art by proposing a decorative piece obtained by inlay work that is simple to perform, very reproducible and compatible with most structures that can be inlaid.

The invention therefore concerns the aforecited decorative piece, which is characterized in that one of the parts of which it is formed is made of an at least partially amorphous material. Advantageous embodiments of this decorative object form the subject of the dependent claims 44 to 61.

Advantageously, the decorative piece according to the present invention is made in part of an amorphous material, so as to open new perspectives in terms of shaping.

Indeed, the viscosity of these materials drops significantly at low temperatures, which allows them to be shaped under low pressure. More specifically, the amorphous material is shaped between its vitreous transition temperature Tg and its crystallisation temperature Tx. For example, for a platinum based amorphous material, the inlay is performed at around 300° C. for a viscosity of up to $10^3$ Pa·s$^{-1}$ for a pressure of 1 Mpa, instead of a viscosity of $10^{12}$ Pa·s$^{-1}$ at temperature Tg.

In the case of inlaid decorative pieces, this viscosity provides improved adhesion features. Indeed, the low viscosity of amorphous materials between Tg and Tx first of all allows them perfectly to fill the space in which they are pressed, and at a low pressure. Thus, in the case of filing a hollow or in the case of an amorphous metal in which aesthetic elements are inlaid, this ability to perfectly match the contours means that either the hollows are faithfully filled, or the aesthetic elements are well covered. As explained above, shaping at a low temperature allows the use of materials that were not used before because of their poor thermal resistance (drop in mechanical properties, oxidisation, or low melting point) or their poor resistance to thermal shocks. The following non-exhaustive list of systems may be given as examples: wood—amorphous metal; mineral glass—amorphous metal; ceramic—amorphous metal; polymer—amorphous metal; graphite—amorphous metal; metal—amorphous metal; concrete—amorphous metal; stone—amorphous metal; composite—amorphous metal.

Finally, the amorphous metals have no limit as regards the thickness of the material that can be inlaid.

The invention also concerns a method of securing an aesthetic element onto a support. This method includes the steps of:

- providing a support made of a first material;
- providing at least one aesthetic element made of a second material;
- inlaying by pressing said at least one aesthetic element in the support;

The method is characterized in that the first or second materials are at least partially amorphous metallic materials so as to facilitate said inlaying step.

Advantageous embodiments of this method form the subject of claims 30 to 42.

The invention also concerns a timepiece that is characterized in that it includes at least one decorative piece according to one of the variants of the present invention.

BRIEF DESCRIPTION OF THE DRAWINGS

The objects, advantages and features of the decorative piece according to the present invention will appear more clearly upon reading the following detailed description of at least one embodiment of the invention given solely by way of non-limiting example and illustrated by the annexed drawings, in which:

FIGS. 3 to 7 show schematically the steps of the method for making said first embodiment;

FIG. 8 shows a first variant of holding means according to the invention;

FIG. 9 shows a second variant of holding means according to the invention;

FIG. 10 shows schematically a view of the decorative piece according to a second embodiment of the present invention, and FIGS. 11 to 14 show schematically the steps of the method for making said second embodiment.

DETAILED DESCRIPTION

In the following description, all those parts of the decorative piece that are well known to those skilled in the art in this technical field will be explained only in a simplified manner.

Figure 1:
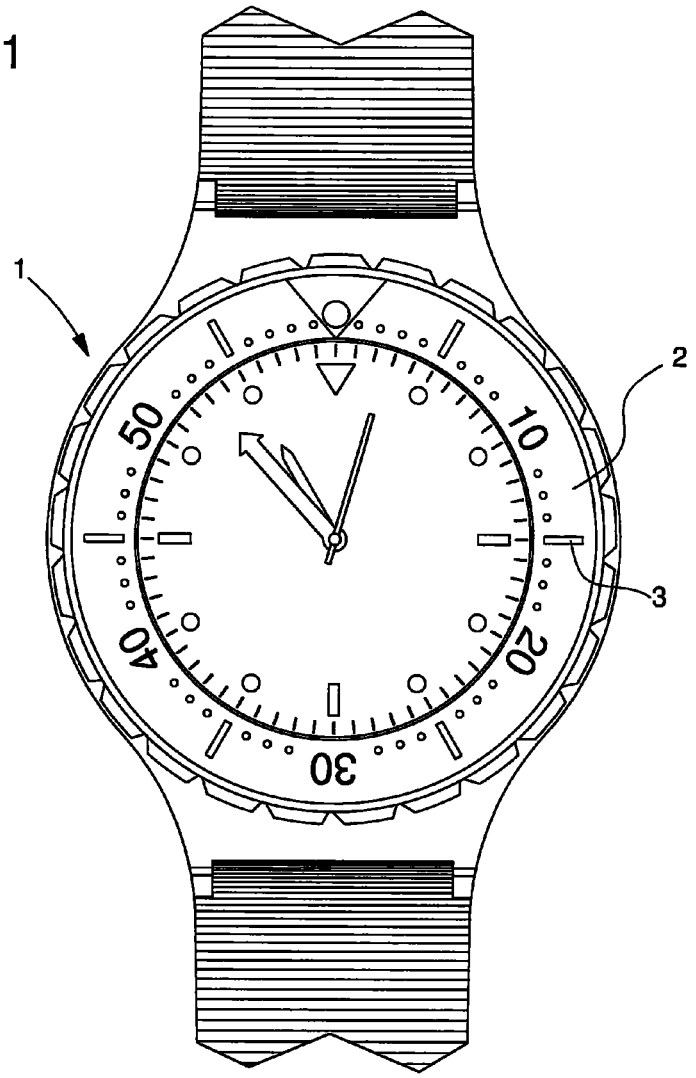
FIG. 1 shows schematically a view of the decorative piece according to a first embodiment of the present invention.

As visible in FIG. 1, the present invention is a decorative piece 1. It is formed of a first part 2 and a second part 3. The two parts 2, 3 are arranged to be secured to each other. More specifically, the second part 3 will be inlaid in first part 2. For example, the first part may be a support 2 and the second part 3 may be one or several aesthetic elements.

Figure 2:
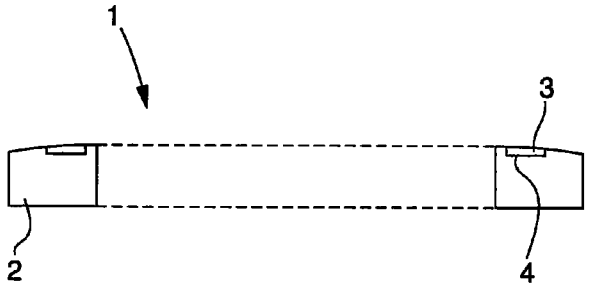
FIG. 2 shows schematically a partial cross-section A-A' of FIG. 1.

FIGS. 1 and 2 show a first embodiment according to the invention. In this embodiment, decorative piece 1 may be, for example, a watch bezel inlaid with signs. It is clear that the bezel includes an annular body forming support 2 in which signs, forming aesthetic elements 3, are inlaid. The bezel may be made, for example, of ceramic material and may include recesses or hollows 4, shown in FIG. 2, arranged on said bezel for receiving the inlaid signs. This inlay advantageously enables said signs to be partially covered and thus gives the product a longer life time by preventing the constituent parts 2, 3 of decorative piece 1 from becoming detached.

Each hollow 4 then takes the form of a design corresponding to the sign to be inlaid and has sides or lateral walls 7, preferably approximately perpendicular to the visible surface. Hollows 4 are filled so that the signs project, are flush with or form a hollow relative to the annular body.

Thus, to fill said hollows 4, the present invention envisages using an amorphous or partially amorphous and preferably metal material. Likewise, it may be possible to use a precious metal or an alloy thereof to give said decorative piece a distinguished character.

As explained above, amorphous materials have the advantage of being easy to shape. Thus, when the temperature of the amorphous material is comprised between the vitreous transition temperature Tg and the crystallisation temperature Tx, viscosity decreases sharply.

This feature allows shaping to be performed with low pressure and at a low temperature using, for example, a hot press. It is thus no longer necessary to use complex methods as is the case for electroforming.

This type of material is well suited to making inlaid parts because it can easily fill the entire volume of hollow 4. After cooling, the vertical sides 7 can retain the amorphous material via friction. Of course, sides 7 may be inclined so as to shrink the surface of the horizontal plane at the bottom of hollow 4 or, conversely, to enlarge it. It goes without saying that the case where the surface of the bottom of the hollow is the larger is the most advantageous since it allows the amorphous material to be retained naturally in hollow 4. Conversely, when the inclination generates a larger section at the surface of the annular body, the amorphous material is no longer held in the hollow in an optimum manner.

Other holding means 5, 6 can be envisaged for securing aesthetic element 3 in hollow 4. One solution consists in providing recesses 5 in the bottom or on sides 7 of hollows 4, as shown in FIG. 8.

When hollow 4 is filled, the low viscosity of the amorphous material, which enables hollow 4 to be properly filled, also allows these recesses 5 to be filled. The recesses are then arranged so that once the amorphous material has cooled it is held in hollow 4.

It is also possible to use outgrowths 6, as shown in FIG. 9, which are arranged in hollow 4 and then play a similar part to means for holding the amorphous material in said hollow 4.

It will be clear that the ceramic material is not the only material that can be inlaid. Thus, synthetic sapphire or enamel can be inlaid in the same way. These synthetic sapphire or enamel supports 2 may be used respectively as the watch crystal and dial. Indeed, in the case of a sapphire crystal, it is advantageous to inlay the amorphous material so as to form hour circle type signs on the bottom of said crystal for a three-dimensional visual effect where the signs are above the hands.

Similarly, it is clear that it is easier to inlay an amorphous material in enamel. Indeed, in the case of a crystalline metal, the force necessary to deform the metal and inlay it is not compatible with the fragility of enamel, which is not the case with an amorphous material.

FIGS. 3 to 7 show, in a simplified manner, the steps of inlaying signs 3 in said support 2. Beforehand, support 2 must be made as seen in FIG. 3, and a preform must be made of amorphous metal alloy. This preform is made by rapidly cooling said amorphous metal alloy once it has been poured into a mould. If support 2 is a watch bezel, the preform is made in an annular shape wherein the diameter and width of the ring are of approximately equivalent dimensions to those of the hollows in the bezel.

Once the preform has been made, it is placed above said bezel as shown in FIG. 4, on the surface where said hollows 4 open out to perform the inlay work by heat forming. The assembly is then placed in a hot press, which will heat the assembly to a temperature comprised between the vitreous transition temperature Tg, and the crystallisation temperature Tx, for reducing the viscosity of the preform, then pressure is exerted. Once these conditions are combined, the pressure exerted on the viscous preform allows the amorphous viscous alloy to fill hollows 4 as seen in FIG. 5. Next, when hollows 4 are filled as seen in FIG. 6, the assembly is rapidly cooled to preserve the amorphous state of the alloy. The inlay operation is then followed by a finishing step such as polishing, as seen in FIG. 7, for removing the surplus amorphous material.

According to a second embodiment of the invention, support 2 is made of amorphous material. It is then possible to use the shaping properties of these two materials to inlay aesthetic elements 3 as seen in FIG. 10. Indeed, in the second embodiment, these properties are used to match the contours of at least one aesthetic element. Support 2 then advantageously takes the form of a piece with substantially equivalent dimensions to the final piece in which it is then possible to inlay aesthetic elements 3 of all types, made of various materials.

Thus, to make decorative piece 1 according to this second embodiment, the method is the same as that described previously, i.e. the elements to be inlaid are pressed onto support 2. This method is described in FIGS. 11 to 14. In this case, it is support 2 that is heated to make it viscous and to inlay therein said aesthetic elements 3. Thus, as seen in FIG. 11, aesthetic element 3 is placed on said support 2: the assembly is then heated and pressed in a hot press as seen in FIG. 12. In the example shown in FIGS. 11 to 14, the pressure is localised on the element to be inlaid alone. It is clear that the pressure can be exerted over the entire decorative piece. This operation is carried out until aesthetic element 3 is partially covered in said support 2 as seen in FIG. 13. Once the amorphous material has cooled, polishing is carried out to remove the surplus material, as shown in FIG. 14.

According to a first variant, aesthetic elements 3 can be made of crystalline metal. This variant can thus make a metal decorative piece 1 formed of two metals, which are not mixed. The metal aesthetic element(s) 3 can be made in various ways such as sintering.

According to a second variant of the invention, the aesthetic elements 3 are transparent or semi-transparent elements. Indeed, the fact of being able to inlay various types of aesthetic elements 3 means that advantageous visual arrangements can be achieved. Thus, transparent or semi-transparent materials such as coloured glass can form a semi-transparent decorative piece 1 like a watch dial or the back cover of a case. This particular arrangement thus enables the watch mechanism to be seen through the case. In that case, the removal of material by polishing is achieved such that the transparent aesthetic element passes through support 2.

According to a third embodiment of the invention, aesthetic elements 3 are made of enamel. A mixed decorative piece 1 can be made of amorphous material—enamel, offering a particular visual appearance while being simpler to produce. Indeed, to inlay enamel elements on a crystalline metal, the features of the metal, such as, amongst others, the melting point of the metal and the expansion coefficient, mean that the inlay is complex. This is not the case for an amorphous material for which the temperature at which the material becomes viscous is lower, allowing inlay work at lower pressure. This lower pressure exerted on the enamel then means that the enamel does not break.

For these three variants, the viscosity of the amorphous material forming support 2 enables said material to creep into every corner thereby solidly securing aesthetic elements 3 in support 2.

Of course, the above variants are not limited to inlaying a single aesthetic element. Indeed, several aesthetic elements, which may or may not be connected, could be inlayed in said support 2 made of amorphous material. Thus, in a fourth variant, the aesthetic elements 3 are arranged to form a figure which will be inlaid in support 2. For example, this figure may be formed of balls of coloured glass arranged to form a figure, such as for example, a logo. This logo is then inlaid in an amorphous material. The advantage of the amorphous metal in this variant is that the latter will fill the spaces between aesthetic elements 3 perfectly, providing both an interesting visual effect and efficient inlay work.

Finally, another variant, for both the case in which support 2 is made of amorphous material and the case in which aesthetic elements 3 are made of amorphous materials, consists in making decorative pieces with a different surface state. One of the two parts of decorative piece 1 could be polished and the other satimated. This possibility of different surface states can be envisaged because of the difference in hardness between the two parts and the difference in thickness.

Of course, this type of support 2 made of amorphous material can be used in a timepiece. Indeed, this type of decorative piece 1 can be used as a dial for said timepiece or as the back cover of a timepiece case.

It will be clear that various alterations and/or improvements and/or combinations that are evident to those skilled in the art may be made to the different embodiments of the invention explained above without departing from the scope of the invention defined by the annexed claims.

The invention claimed is:

1. A method for securing at least one aesthetic element on a support including the steps of:

providing a support made of a first material;

providing at least one aesthetic element made of a second material; and inlaying by pressing said at least one aesthetic element in the support;

wherein the first or second materials are of the at least partially amorphous, metallic type so as to facilitate said inlaying step.

2. The securing method according to claim 1, wherein said support is made of at least partially amorphous, metallic material and in that said at least one element is embedded in said support during the inlay step.

3. The securing method according to claim 1, wherein said support and said at least one aesthetic element is made of at least partially amorphous metallic material.

4. The securing method according to claim 1, wherein the inlay is made by heat forming.

5. The securing method according to claim 1, wherein said at least one metallic material is totally amorphous.

6. The securing method according to claim 1, wherein said at least one metallic material is of the precious metal type or an alloy thereof.

7. The securing method according to claim 1, wherein the support is an element of a timepiece.

8. The securing method according to claim 1, wherein said at least one aesthetic element is made of at least partially amorphous, metallic material and wherein said aesthetic element is embedded in a hollow of said support.

9. The securing method according to claim 8, wherein said at least one hollow includes vertical sides so as to improve the hold of each aesthetic element in the support.

10. The securing method according to claim 8, wherein said at least one hollow includes sides arranged so that the area of the hollow increases with the depth of the hollow.

11. The securing method according to claim 8, wherein said at least one hollow includes sides arranged so that the area of the hollow decreases with the depth of the hollow.

12. The securing method according to claim 8, wherein said at least one hollow includes holding means extending from one of the faces of the hollow for securing the aesthetic element in said hollow.

13. The securing method according to claim 12, wherein said holding means are in the form of at least one record.

14. The securing method according to claim 12, wherein said holding means are in the form of at least are one outgrowth.

15. A decorative piece including:

a solid support into which at least one predefined hollow is arranged; and at least one aesthetic element which is arranged so that each aesthetic element is inlayed in one hollow of the support, wherein said at least one aesthetic element includes an at least partially amorphous metallic material.

16. The decorative piece according to claim 15, wherein said metallic material is of the precious metal type or an alloy thereof.

17. The decorative piece according to claim 15, wherein said at least one hollow includes vertical sides so as to improve the hold of each aesthetic element in the support.

18. The decorative piece according to claim 15, wherein said at least one hollow includes sides arranged so that the area of the hollow increases with the depth of the hollow.

19. The decorative piece according to claim 15, wherein said at least one hollow includes sides arranged so that the area of the hollow decreases with the depth of the hollow.

20. A timepiece including at least one decorative piece according to claim 15.

21. The timepiece according to claim 20, wherein the decorative piece is a watch bezel.

22. The timepiece according to claim 21, wherein the watch bezel is in ceramic material.

23. The timepiece according to claim 20, wherein the decorative piece is a watch crystal.

24. The timepiece according to claim 20, wherein the decorative piece is a watch dial.

25. The decorative piece according to claim 15, wherein said metallic material is totally amorphous.

26. A timepiece including at least one decorative piece according to claim 25.

27. The timepiece according to claim 26, wherein the decorative piece is a watch bezel.

28. The timepiece according to claim 27, wherein the watch bezel is in ceramic material.

29. The timepiece according to claim 26, wherein the decorative piece is a watch crystal.

30. The decorative piece according to claim 15, wherein the at least one hollow includes holding means extending from one of the faces of the hollow for securing the aesthetic element in said hollow.

31. The decorative piece according to claim 30, said holding means is in the form of at least one record.

32. The decorative piece according to claim 30, said holding means is in the form of at least one outgrowth.

33. The timepiece according to claim 26, wherein the decorative piece is a watch dial.

* * * * *